US008136591B2

(12) United States Patent
Del Campo et al.

(10) Patent No.: US 8,136,591 B2
(45) Date of Patent: Mar. 20, 2012

(54) METHOD AND SYSTEM FOR USING WIRELINE CONFIGURABLE WELLBORE INSTRUMENTS WITH A WIRED PIPE STRING

(75) Inventors: Christopher S. Del Campo, Houston, TX (US); Harold S. Bissonnette, Sugar Land, TX (US); Reza Taherian, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 310 days.

(21) Appl. No.: 12/475,845

(22) Filed: Jun. 1, 2009

(65) Prior Publication Data

US 2010/0300685 A1 Dec. 2, 2010

(51) Int. Cl.
*E21B 47/12* (2006.01)

(52) U.S. Cl. ..... 166/254.2; 166/385; 175/50

(58) Field of Classification Search ..... 166/254.2, 166/250.01, 385; 175/50
See application file for complete search history.

(56) References Cited

U.S. PATENT DOCUMENTS

| | | | | |
|---|---|---|---|---|
| 5,433,276 | A | 7/1995 | Martain et al. | |
| 6,092,416 | A | 7/2000 | Halford et al. | |
| 6,641,434 | B2 | 11/2003 | Boyle et al. | |
| 6,655,460 | B2 | 12/2003 | Bailey et al. | |
| 6,827,149 | B2 | 12/2004 | Hache | |
| 6,896,075 | B2 | 5/2005 | Haugen et al. | |
| 7,025,130 | B2 | 4/2006 | Bailey et al. | |
| 7,080,699 | B2 | 7/2006 | Lovell et al. | |
| 7,819,206 | B2 * | 10/2010 | Peter | 175/50 |
| 2007/0044959 | A1 | 3/2007 | Georgi | |
| 2008/0015781 | A1 | 1/2008 | Niemeyer et al. | |
| 2008/0217057 | A1 | 9/2008 | Hall et al. | |
| 2008/0223125 | A1 | 9/2008 | Meister | |
| 2008/0234938 | A1 | 9/2008 | Niemeyer et al. | |
| 2009/0173493 | A1 * | 7/2009 | Hutin et al. | 166/250.01 |
| 2010/0071910 | A1 * | 3/2010 | Ellson et al. | 166/385 |
| 2010/0116550 | A1 * | 5/2010 | Hutin et al. | 175/40 |

* cited by examiner

*Primary Examiner* — Giovanna Wright
(74) *Attorney, Agent, or Firm* — David J Smith

(57) ABSTRACT

A wellbore instrument system includes a pipe string extending from earth's surface into a wellbore. The pipe string includes at least one of an electrical conductor and an optical fiber signal communication channel. A power sub is coupled to at least one wireline configurable wellbore instrument. The power sub is also coupled to the pipe string. The instrument is configured to receive electrical power from the power sub. The instrument includes at least one sensor responsive to at least one of movement of the instrument, change in a instrument operating condition and an environmental condition proximate the instrument. The sensor is configured to transmit signals therefrom over the communication channel.

23 Claims, 5 Drawing Sheets

METHOD AND SYSTEM FOR USING WIRELINE CONFIGURABLE WELLBORE INSTRUMENTS WITH A WIRED PIPE STRING

BACKGROUND OF THE INVENTION

1. Field of the Invention

The invention relates generally to the field of wellbore instruments and well logging methods. More specifically, the invention relates to systems and methods for operating electrically powered instruments in a well using a wired pipe string as a signal communication channel.

2. Background Art

Well logging instruments are devices configured to move through a wellbore drilled through subsurface rock formations. The devices include one or more sensors and other devices that measure various properties of the subsurface rock formations and/or perform certain mechanical acts on the formations, such as drilling or percussively obtaining samples of the rock formations, and withdrawing samples of connate fluid from the rock formations. Measurements of the properties of the rock formations made by the sensors may be recorded with respect to the instrument axial position (depth) within the wellbore as the instrument is moved along the wellbore. Such recording is referred to as a "well log."

Well logging instruments can be conveyed along the wellbore by extending and withdrawing an armored electrical cable ("wireline"), wherein the instruments are coupled to the end of the wireline. Such conveyance relies on gravity to move the instruments into the wellbore. Extending and withdrawing the wireline may be performed using a winch or similar spooling device known in the art. It is also known in the art to use "logging while drilling" ("LWD") instruments in certain circumstances. Such circumstances include expensive drilling operations, where the time needed to suspend drilling operations in order to make the wellbore accessible to wireline instruments would make the cost of such access prohibitive, and wellbores having a substantial lateral displacement from the surface location of the well. Such circumstances can also include large lateral displacement of the wellbore particularly where long wellbore segments having high inclination (deviation from vertical). In such cases, gravity is not able to overcome friction between the instruments and the wellbore wall, thus making wireline conveyance impracticable. LWD instrumentation has proven technically and economically successful under the appropriate conditions.

There are several types of wireline instrument conveyance known in the art for the foregoing conditions. One conveyance technique includes coupling the wireline instruments to the end of a coiled tubing having a wireline disposed therein. The wireline instruments are extended into and withdrawn from the wellbore by extending and retracting the coiled tubing, respectively. A subset of such coiled tubing techniques includes preliminary conveyance of the wireline configurable well logging instruments to a selected depth in the wellbore using a threadedly coupled pipe "string." See, for example, U.S. Pat. No. 5,433,276 issued to Martain et al.

Another well logging instrument conveyance technique includes coupling wireline configurable well logging instruments to the end of a drill pipe or similar threadedly coupled pipe string. A wireline is coupled to the instruments using a "side entry sub" which provides a sealable passage from the exterior of the pipe string to the interior thereof. As the pipe string is extended into the wellbore, the wireline is extended by operating a conventional winch. An example of the foregoing is described in U.S. Pat. No. 6,092,416 issued to Halford et al. and assigned to the assignee of the present invention.

Recently, a type of drill pipe has been developed that includes a signal communication channel. See, for example, U.S. Pat. No. 6,641,434 issued to Boyle et al. and assigned to the assignee of the present invention. Such drill pipe has in particular provided substantially increased signal telemetry speed for use with LWD instruments over conventional LWD signal telemetry, which typically is performed by mud pressure modulation or by very low frequency electromagnetic signal transmission.

The foregoing drill pipe having a signal communication channel has not proven effective at transmitting electrical power from the surface to an instrument string disposed at a lower end of the pipe. In wireline conveyance of wellbore instrument, electrical power is transmitted from the surface to the instruments in the wellbore using one or more of the electrical conductors in the cable. In MWD and LWD, electrical power may be provided by batteries, or by an electric generator operated by flow of fluid through the drill pipe. When wired drill pipe is used for signal telemetry, the amount of electrical power required by the instruments may be substantially reduced because the signal telemetry device used in MWD/LWD, typically a mud flow modulator, uses a substantial portion of the total electrical power used by the instruments.

It has also been observed that wired drill pipe, while having substantially faster data transmission capability than mud flow modulation telemetry and low frequency electromagnetic telemetry, is still somewhat band limited when used with certain types of well logging instruments. In certain cases, wireline configurable well logging instruments may be used with wired drill pipe. Such instruments may generate data at rates that exceed the bandwidth of the signal communication channel in wired drill pipe. Some of the measurements made by such instruments relate to instrument operation, that is, whether an operation in progress should continue or be altered and whether instrument operating conditions such as ambient environmental conditions may expose the instrument to risk of loss or damage. There exists a need, therefore, for wireline configurable well logging instruments to be operated using wired pipe strings for data communication, wherein certain information critical to controlling operation of the instruments may be preferentially communicated to the surface to enable the system operator to make operational decisions therefrom.

SUMMARY OF THE INVENTION

A wellbore instrument system according to one aspect of the invention includes a pipe string extending from earth's surface to a selected depth in wellbore. The pipe string includes at least one of an electrical conductor and an optical fiber signal communication channel. A power sub is coupled to at least one wireline configurable wellbore instrument. The power sub is also coupled to the pipe string. The instrument is configured to receive electrical power from the power sub. The instrument includes at least one sensor responsive to at least one of movement of the instrument, change in a instrument operating condition and an environmental condition proximate the instrument. The sensor is configured to transmit signals therefrom over the communication channel.

A method for well logging according to another aspect of the invention includes moving at least one wireline configurable wellbore instrument along a wellbore at one end of a segmented pipe string. The pipe string includes a signal communication channel associated therewith. The method includes communicating measurements from at least one sensor in the instrument to the signal communication channel. The communicated measurements are detected at a surface end of the communication channel. At least one instrument operation is changed in response to the detected measurements.

Other aspects and advantages of the invention will be apparent from the following description and the appended claims.

DETAILED DESCRIPTION

Generally, the invention relates to devices and methods for conveying a wellbore instrument or a "string" of such instruments through a wellbore using a wired pipe string for instrument conveyance and for signal communication. The wired pipe string may include an electrical generator and power storage module or "sub" for supplying electrical power to operate the instrument and for providing telemetry to a signal communication channel in the wired pipe string. The wired pipe string may be assembled and disassembled in segments to effect conveyance in a manner known in the art for conveyance of segmented pipe through a wellbore.

Figure 1:
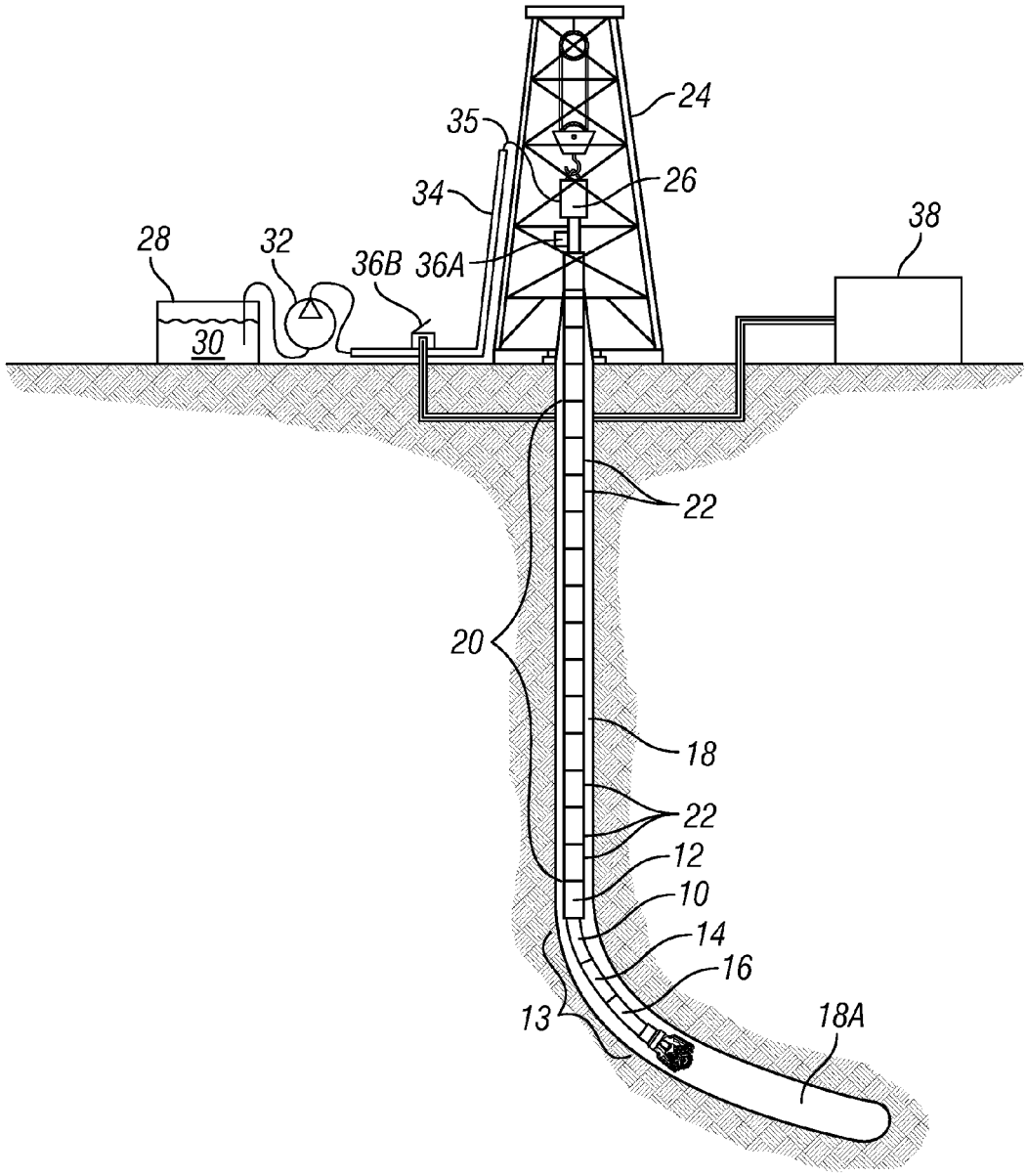
FIG. 1 shows an example of "wireline configurable" well logging instruments conveyed through a wellbore using a wired pipe string.

In FIG. 1, a drilling rig 24 or similar lifting device moves a conduit or pipe called a "wired pipe string" 20 within a wellbore 18 that has been drilled through subsurface rock formations, shown generally at 11. The wired pipe string 20 may be extended into the wellbore 18 by threadedly coupling together end to end a number of segments ("joints") 22 of wired drill pipe. Wired drill pipe may be structurally similar to ordinary drill pipe and include a signal communication channel, such as a cable or an optical fiber, extending along the length of each drill pipe. For example, the signal communication channel may consist of a conduit extending partially or substantially within the interior of each drill pipe joint. In an embodiment, the signal communication channel extends within the body of each end of the drill pipe such that the signal communication channel is positioned between an interior diameter and an exterior diameter at the ends of each drill pipe. At each end of the wired drill pipe joint, a signal coupling device is used to communicate signals along the channel between pipe joints when the pipe joints are coupled end to end as shown in FIG. 1. See, as a non-limiting example, U.S. Pat. No. 6,641,434 issued to Boyle et al. and assigned to the assignee of the present invention for a description of a type of wired drill pipe that can be used with the present invention.

The wired pipe string 20 may include an assembly or "string" of wellbore instruments at a lower end thereof. In the present example, the wellbore instrument string may include wireline configurable well logging instruments 13 coupled to a lower end thereof. As used in the present description, the term "wireline configurable well logging instruments" or a string of such instruments means one or more well logging instruments that can be conveyed through a wellbore using armored electrical cable ("wireline"), and which cannot be used in a pipe string for conducting drilling operations as a part of the pipe string. Wireline configurable well logging instruments are thus distinguishable from "logging while drilling" ("LWD") instruments, which are configurable to be used during drilling operations and form part of the pipe string itself. The wireline configurable well logging instruments 13 may include tools for measuring characteristics of the formation, such as electrical properties, sonic properties, active and passive nuclear properties, dimensional properties of the wellbore, formation fluid sampling, formation pressure measurement, coring sample measurements and the like. The purpose for coupling the wireline configurable logging instrument string 13 to the end of the wired pipe string 20 will be further explained below.

Several of the components disposed proximate the drilling unit 24 may be used to operate part of the system of the invention. These components will be explained with respect to their uses in drilling the wellbore to better enable understanding the invention. The wired pipe string 20 may be used to turn and axially urge a drill bit (not shown) into the bottom of the wellbore 18 to increase its length (depth). During drilling of the wellbore 18, a pump 32 lifts drilling fluid ("mud") 30 from a tank 28 or pit and discharges the mud 30 under pressure through a standpipe 34 and flexible conduit 35 or hose, through the top drive 26 and into an interior passage (not shown separately in FIG. 1) inside the wired pipe string 20. The mud 30 exits the drill string 20 through courses or nozzles (not shown separately) in the drill bit (not shown), where it then cools and lubricates the drill bit and lifts drill cuttings generated by the drill bit (not shown) to the Earth's surface.

When the wellbore 18 has been drilled to a selected depth, the wired pipe string 20 may be withdrawn from the wellbore 18, and an adapter/power generator sub 12 ("power sub" for convenience hereinafter) and the well logging instruments (or "instrument string") 13 may be coupled to the end of the wired pipe string 20. The power sub 12 may consist of one or more subs in one or more separate drilling collars. In an embodiment, the power sub 12 may consist of a single sub in a single drill collar providing power and a communication interface to the drilling unit 24 and/or the well logging instrument string 13. In another embodiment, the power sub 12 may consist of two subs in two separate drilling collars—one providing power to the well logging instrument string 13 and the other providing an interface for communication with the drilling unit 24 and/or the well logging instrument string 13. Of course, a person having ordinary skill in the art will understand that the present invention is not limited to a certain embodiment of the power sub 12 and that variations may be needed or required depending on the structure of the wired drill pipe, the drilling unit 24, the well logging instrument string 13, and/or the formation.

Upon positioning the well logging instrument string 13 on the wired drill pipe string 20, the wired pipe string 20 may then be reinserted into the wellbore 18 so that the well logging instrument string 13 may be moved through the wellbore 18. Advantageously, the well logging instrument string 13 positioned on the wired pipe string 20 permits formation measurements on highly inclined or deviated portions 18A of the wellbore 18. which would be inaccessible or at least difficult using armored electrical cable ("wireline") to move the instruments 13. During well logging operations, the pump 32 may be operated to provide fluid flow to operate one or more turbines (not shown in FIG. 1) in the well logging instrument string 13 (or in the power sub 12) to provide power to operate certain devices in the well logging instrument string 13. Other methods of providing power may be incorporated. For example, the power sub 12, other portion of the wired pipe string 20 and/or the well logging instrument string 13 may have batteries to provide power to the well logging instrument string 13. In an embodiment, the batteries may be rechargeable during fluid flow, when a mud turbine operated generator is functioning, for example, and the batteries may provide power to the well logging instrument string 13 when the mud turbine is not in operation or may supplement the power during operation of the mud turbine.

As the well logging instrument string 13 is moved along the wellbore 18 by moving the pipe string 20 as explained above, signals detected by various devices, non-limiting examples of which may include a resistivity instrument 16, a gamma ray sensor 14 and an acoustic well logging sensor 10 are selected to be included in a telemetry transceiver (explained below with reference to FIG. 4) in the power sub 12 for communication along the signal channel in the wired pipe string 20. A the surface, a telemetry transmitter 36A can be used to transmit signals, such as wirelessly transmit signals, from the wired pipe string 20 to a receiver 36B. In such an embodiment, the wired pipe string 20 may be freely moved, assembled, disassembled and rotated without the need to make or break a wired electrical or optical signal connection. Signals from the receiver 36B, which may be electrical and/or optical signals, for example, may be conducted (such as by wire or cable) to a recording unit 38 for decoding and interpretation using techniques well known in the art. The decoded signals typically correspond to the measurements made by one or more of the sensors in the well logging instruments 10, 14, 16. Other sensors known in the art include, without limitation, density sensors, neutron porosity sensors, acoustic travel time or velocity sensors, seismic sensors, neutron induced gamma spectroscopy sensors and microresistivity (imaging) sensors. It should be understood that the transmitter 36A and receiver 36B may be substituted by transceivers so that signal communication may also be provided from the recording system 38 to the instrument string 13 or any component thereof.

The functions performed by the power sub 12 may include providing a mechanical coupling (explained below) between the wired pipe string 20 (e.g., at the lowermost threaded connection) and an uppermost connection on the well logging instrument string 13. The power sub 12 may also include one or more devices (explained below) for producing electrical power to operate various parts of the well logging instruments 13. Finally, the power sub 12 may include signal processing and recording devices (explained below with reference to FIG. 4) for selecting particular signals from the well logging instrument string 13 for transmission to the surface using the communication channel in the wired pipe string 20 and recording signals in a suitable storage or recording device (explained below) in the power sub 12. The power sub 12 may include processing or computing capabilities to prioritize and/or interpret certain data prior to transmission to the surface. Signals transmitted from the surface may be communicated through the communication channel in the pipe string 20 to the instrument string 13 through the various devices (FIG. 4) in the power sub 12.

It will be appreciated by those skilled in the art that in other examples the top drive 26 may be substituted by a swivel, kelly, kelly bushing and rotary table (none shown in FIG. 1) for rotating the pipe string 20 while providing a pressure sealed passage through the pipe string 20 for the mud 30. Accordingly, the invention is not limited in scope to use with top drive drilling systems.

Figure 2:
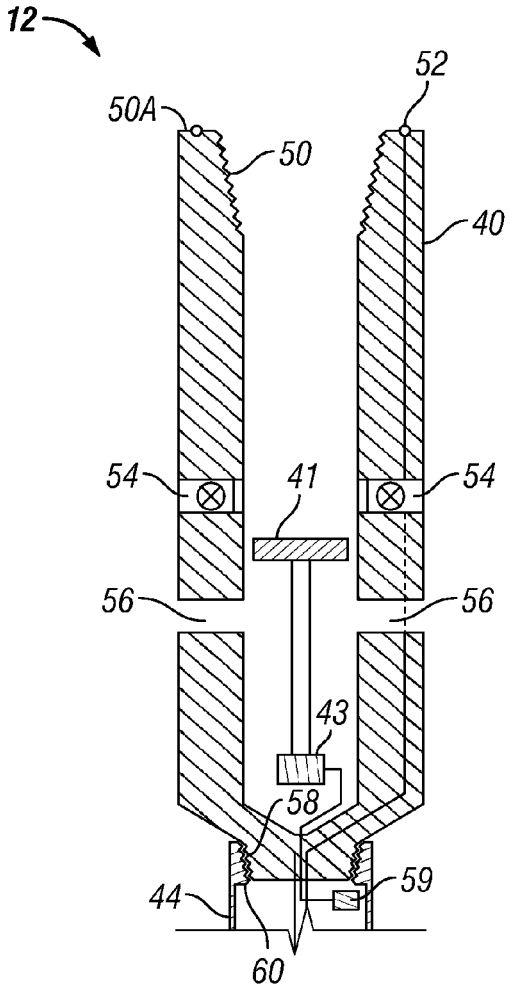
FIG. 2 shows a power generator portion of an adapter sub.

Having explained the system components generally, more detailed description of examples of certain system components follows. FIG. 2 shows one example of the power sub 12. Wired drill pipe, such as in the above provided example, is known to have digital signal telemetry capacity, such as between one hundred thousand and one million bits per second. Wired drill pipe currently known in the art, however, does not efficiently transmit electrical power. The power sub 12, therefore, may include one or more sources of electrical power to operate the well logging instrument string (13 in FIG. 1). One source of electrical power converts flow of drilling fluid into electric power and includes a turbine 41 that is rotated by flow of drilling fluid moved by the pump (32 in FIG. 1) as explained above. In the present example, the turbine 41 may be disposed in a housing 40. The housing 40 may include threaded connections, e.g., at 50, configured to couple to the lowermost threaded connection on the wired pipe string (20 in FIG. 1). An electric generator 43 or alternator (not shown separately) may be disposed in the housing 40 and may be rotationally coupled to the turbine 41. Use of the terms "generator" and "alternator" herein is intended to be interchangeable in that use of either direct current electric generators or alternating current generators is within the scope of this invention, and the term "generator" as used below and in the appended claims is intended to include both types of device within its scope. Electrical output from the generator 43 may be conditioned to operate various components in the well logging instrument string 13 and/or in a power conditioner module 59. The power conditioner module 59 may include batteries or other electric power storage devices (not shown separately) to provide power during times when the turbine 41 is not operating, for example during "connections" (i.e., when a joint or stand of pipe is added to or removed from the pipe string). The power conditioner module 59 may be disposed in the housing 40, the well logging instrument string 13 or at another location in the wired pipe string 20.

The turbine 41 in some examples may have a controllable response to fluid flow, such as by controllable blade pitch, a controllable brake (not shown) or controllable bypass ports 54. Other methods include a controllable distance between the rotor and stator (either passive—based on the thrust force of the flow/rotational speed or actively controlled) or variable distance between the tips of the turbine blades and the housing (by moving either the turbine or the housing axially relative to the other, with one or both having a coned shape). Again, this could be performed passively based on the thrust force, the rotational speed or combination of the two, or it could be controlled actively. These last two methods effectively alter the efficiency of the turbine 41. Such controllable turbine response feature may provide proper operation of the generator 43 under widely variable electrical load conditions.

The upper threaded connection 50 may include a communication device 52 disposed in a thread shoulder 50A of the upper threaded connection 50. The communication device may be electromagnetic, as explained, for example, in the Boyle et al. patent referred to above. The housing 40 may include one or more controllable bypass valves 54, as explained above. The controllable bypass valves 54 may be operated, for example, by solenoids (not shown) to selectively enable part of the fluid flow through the wired pipe string (20 in FIG. 1) to be diverted into the wellbore (18 in FIG. 1) above turbine 41, thus reducing the output of the turbine 41. The housing 40 may alternatively or additionally include fixed discharge ports 56 below the turbine 41 to enable fluid flow to operate the turbine 41. The housing 40 may include a lower threaded connection 58 that is configured to couple to an upper threaded connection 60 in the well logging instrument string head, shown at 44.

Figure 3:
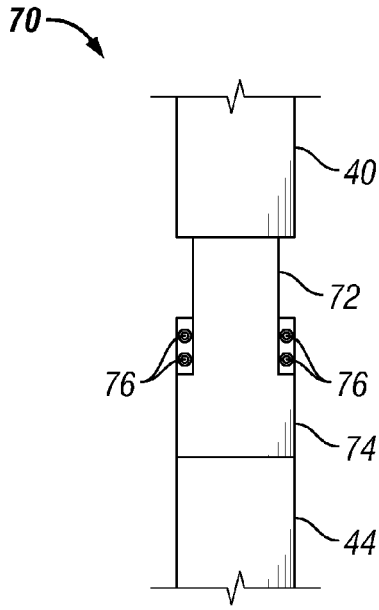
FIG. 3 shows an example of a longitudinal slip joint that may be incorporated in one or more embodiments of the present invention.

In the event that the measurement and/or fluid sampling procedure performed in the wellbore (18 in FIG. 1) requires the well logging instrument string (13 in FIG. 1) to be stationary, but the wired pipe string (20 in FIG. 1) may not be stationary at the surface, e.g. on a floating drilling platform having relatively ineffective heave compensation devices or in heavy wave conditions, a longitudinal slip joint may be included in the well logging instrument string (13 in FIG. 1). The longitudinal slip joint can also be used to compensate for thermal expansion of the wired pipe string (20 in FIG. 1) due to temperature changes. An example slip joint is shown at 70 in FIG. 3. In the present example, the slip joint 70 may include an upper housing 72 engaged, for example, with the turbine housing 40, and a lower housing 74 engaged with the power conditioner module 59. The upper 72 and lower 74 housings may be integrally formed or may be connected, such as slidably engaged, to each other and may be sealed using o-rings 76 or similar sealing device that enables relative longitudinal movement between the upper and lower housings 72, 74.

As is known in the art, typical wireline configurable well logging instruments strings can generate signal data at large multiples of the maximum bandwidth of typical wired pipe strings 20. Accordingly, it is desirable to use the available wired pipe string bandwidth to communicate to the surface those signals from the well logging instrument string (13 in FIG. 1) that are most valuable to obtain substantially as they are measured (in "real time"). Other data that are not typically valuable to obtain in real time, for example, instrument diagnostic measurements, may be stored in a local data storage device. It should be appreciated that the most valuable data may change depending upon the testing or sampling procedures, tool performance, conditions downhole or the like. For example, diagnostic data for a tool may be the most valuable information if the tool is failing or about to fail. It is also desirable to be able to change the particular signals transmitted to the surface in real time, as well as to change the sample rate of such real time transmission. For example, certain well logging measurements, such as induction resistivity corresponding to large lateral distance from the wellbore, change relatively slowly with change in axial position of the well logging instrument string. It may be possible to send such measurements to the surface at relatively slow rates (e.g., 1-100 Hz), while measurements that change more rapidly (e.g. microresistivity measurements made for wellbore imaging) may be transmitted at much higher rates (e.g., 1 KHz to 1000 KHz).

Figure 8:
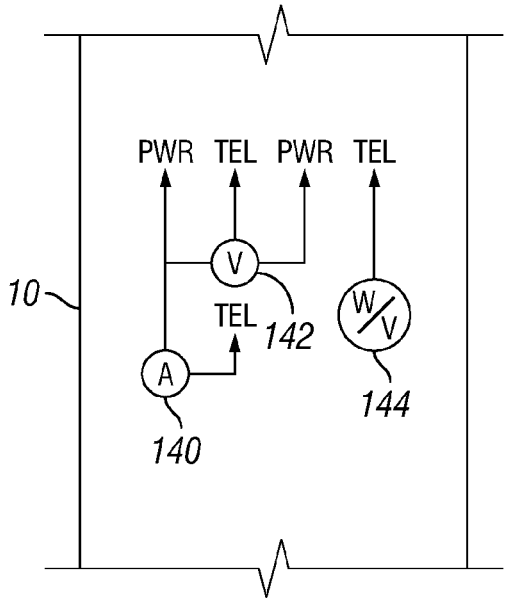
FIG. 8 shows examples of tool operating sensors that may be used in some examples.

In some examples, it is desirable to change the signals transmitted to the surface in real time using the pipe string communication channel when certain conditions exist in the well logging instrument string. FIG. 8 shows examples of sensors that measure instrument operating parameters, that is, parameters related to correct functioning of the well logging instruments themselves. Examples of such sensors include a voltmeter 142 to measure voltage applied to the instrument string, current drawn by the instrument string 140 and internal temperature of the instrument string. The foregoing measurements may be generally stored in a data storage device in the well logging instrument string (13 in FIG. 1) or in the power sub (84 in FIG. 4) if the values of the measurements are within a predetermined safe operating range. In the event any of the instrument operating parameter measurements falls outside the respective predetermined range, the telemetry in the power sub (80 in FIG. 4) may be reconfigured to transmit the out of range measurements to the surface in real time to inform the system operator of the condition in the instrument string. In an embodiment, the instrument operating parameter measurements outside of the predetermined range may be automatically transmitted to the surface, and previously recorded portions of the instrument operating parameter measurements may be requested automatically or as needed by a surface computer (e.g., in the recording system 38 in FIG. 1) or by the system operator.

Figure 4:
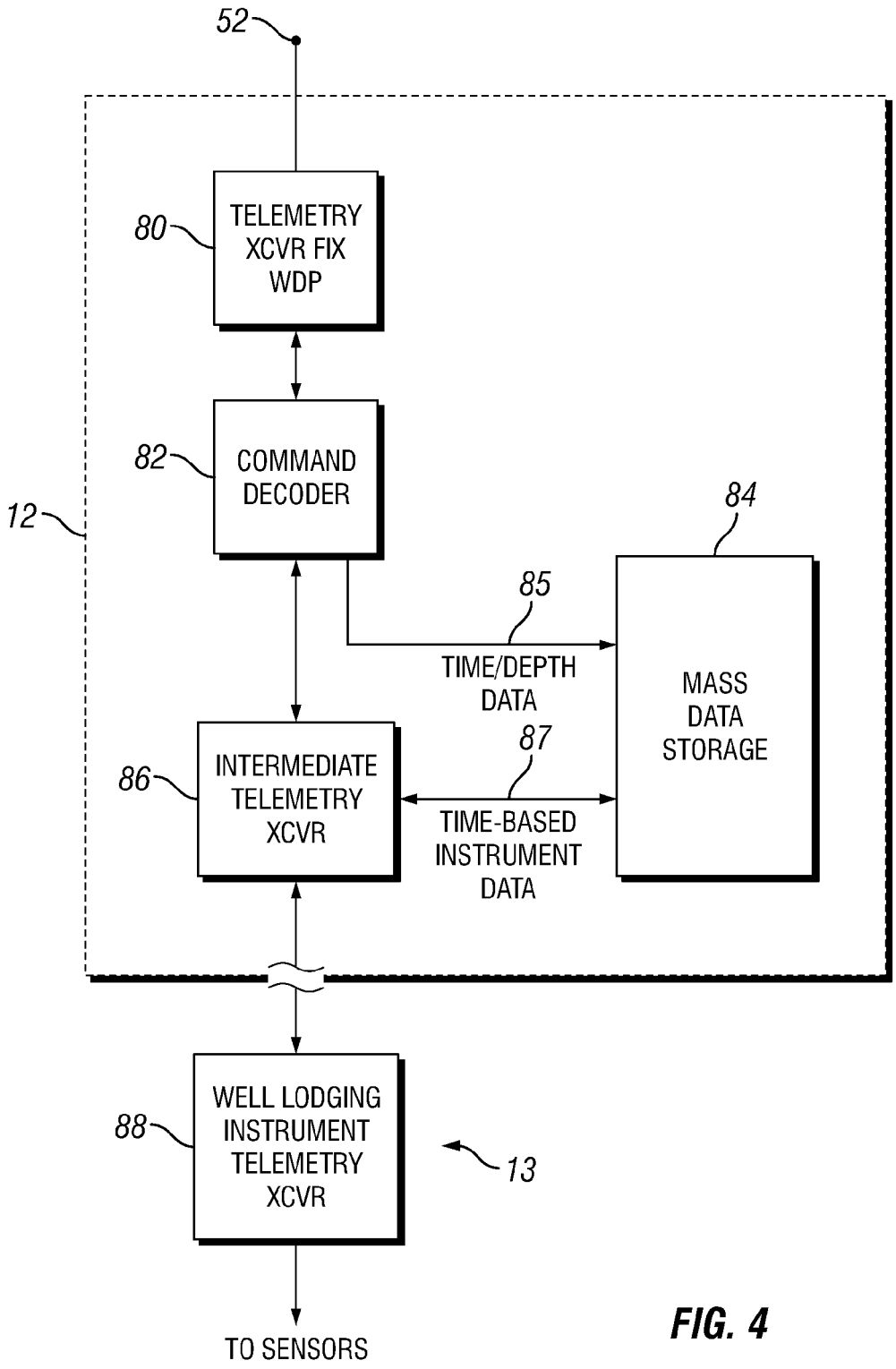
FIG. 4 shows an example of signal processing devices to adapt wireline configurable well logging instrument telemetry to wired pipe string telemetry.

An example signal processing and recording unit that can perform the foregoing telemetry conversion and formatting is shown in block diagram form in FIG. 4. The communication device 52 (also shown FIG. 2) that couples signals to the signal communication channel in the wired pipe string is in signal communication with a telemetry transceiver 80 ("WDP transceiver") configured to communicate signals in the telemetry format used for the wired pipe string (20 in FIG. 1). The WDP transceiver 80 is preferably bidirectional, but may only transmit data in one direction. A command decoder 82 may interrogate the telemetry signals from the WDP transceiver 80 to detect any commands originating from the recording unit (38 in FIG. 1). Such commands may include instructions to deploy (if included on the wireline instrument string) a formation sample tester, to extract samples through the formation tester and to withdraw the formation tester from contact with the formations (11 in FIG. 1). Commands may also include instructions to send different instrument measurement signals from the well logging instrument string (13 in FIG. 1) to the recording unit (38 in FIG. 1) over the wired pipe string. Another type of instruction that may be detected in the command decoder 82 is time/depth records. As the wired pipe string (20 in FIG. 1) is moved along the wellbore (18 in FIG. 1), the axial position in the wellbore (the depth) of a reference point on the wired pipe string (20 in FIG. 1) or on the wireline instrument string (13 in FIG. 1) may be used to indicate the depth of each instrument sensor in the wireline instrument string (13 in FIG. 1). The depth is typically determined by measuring the elevation of the top drive (26 in FIG. 1) and adding to the elevation the length of all the individual components of the wired pipe string (20 in FIG. 1) and wireline instrument string (13 in FIG. 1). The elevation may be recorded automatically in the recording unit (38 in FIG. 1) by use of appropriate sensors on the drilling unit (24 in FIG. 1). Thus at any time the depth of any sensor (and the reference point) on the wired pipe string (20 in FIG. 1) and wireline instrument string (13 in FIG. 1) are determinable. The time/depth data may be transmitted to the power sub 12 and used by the command decoder 82 to generate a record in the mass storage 84 with respect to depth of measurements made by the various sensors in the wireline instrument string (13 in FIG. 1).

The command decoder 82 may transmit instructions to change the data sent over the wired pipe string (20 in FIG. 1) to an intermediate telemetry transceiver 86. The intermediate telemetry transceiver 86 receives well logging instrument measurements from the wireline instrument string (13 in FIG. 1) by signal connection to a well logging instrument telemetry transceiver 88 in the wireline instrument string (13 in FIG. 1). The well logging instrument telemetry transceiver 88 may be the same type as used in any wireline configurable well logging instrument string, and is preferably the same as is used otherwise to transmit signals over an armored electrical cable ("wireline") when the wireline instrument string (13 in FIG. 1) is deployed on a wireline. In the present example, all well logging instrument signals that would be transmitted over the wireline if the instrument string were so connected can be communicated to the intermediate telemetry transceiver 86. Depending on the instruction from the surface (e.g., from the recording system 38 in FIG. 1) some of the signals are communicated to the WDP telemetry transceiver 80 for communication over the wired pipe string communication channel. Remaining well logging instrument signals may be communicated to the mass data storage device 84, which may be, for example, a solid state memory or hard drive. The mass data storage device 84 may also receive and store the same signals that are transmitted to the surface over the wired pipe string. The foregoing components, including the WDP telemetry 80, mass data storage 84, command decoder 82 and intermediate telemetry 86 may be enclosed in the power sub 12 in some examples. In other examples, the foregoing components may be enclosed in a separate housing (not shown) that is itself coupled to the power sub 12 and to the instrument string (13 in FIG. 1).

In general, methods and systems according to the invention may provide a well logging configurable instrument string conveyed into a wellbore by a wired pipe string and using a communication channel in the wired pipe string to communicate measurements to the surface. In the various aspects of the present invention, such measurements can be related to whether a particular action is required by the system operator to be undertaken with respect to operation of the instrument. "Operation of the instrument" may be defined as any information or data relevant to the operation or functioning of the instrument, including whether to continue operating the instrument in the manner being operated or to change an operation or function of the instrument. The foregoing term may also be defined to include determining whether movement of the instrument through the wellbore and/or through the pipe string is taking place and whether to continue the operation related to movement of the instrument. Operation related to movement of the instrument can include, without limitation, insertion into or withdrawal from the wellbore of the pipe string (20 in FIG. 1), and when coupled to an end thereof, corresponding insertion and withdrawal of the wireline instrument string (13 in FIG. 1), or as will be explained with reference to FIG. 7, pumping of fluid into the wired pipe string (20 in FIG. 1) to cause movement of the instrument string in the interior of the pipe string for deployment.

In one example of making a measurement used to determine whether to change an instrument operation, a wireline well logging instrument or string thereof may be configured to transmit measurements to the recording system (38 in FIG. 1) over the pipe string communication channel so that the system operator may determine whether a fluid sample being withdrawn from the wellbore is mud filtrate (defined below) or native formation fluid. Identification of the withdrawn fluid may enable determining when to begin storing fluid withdrawn from the formation in a sample storage tank (not shown) for retrieval at the surface and subsequent analysis.

Figure 5:
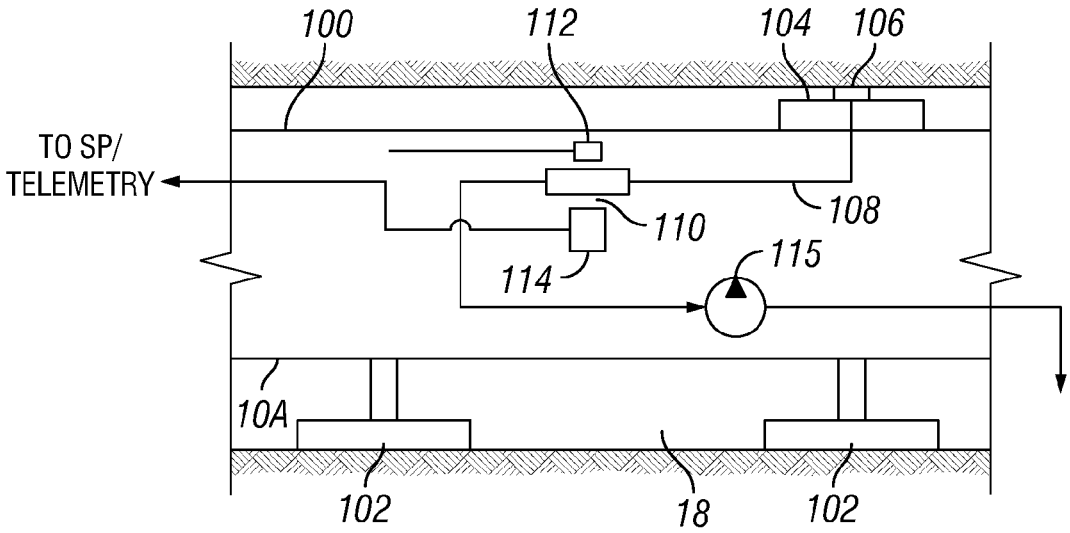
FIG. 5 shows an example formation testing device including a sensor for determining the nature of a fluid withdrawn from a rock formation.

FIG. 5 shows an example of certain relevant components of a formation pressure testing and fluid sample taking instrument 10A to illustrate one implementation of a method according to the invention. The formation testing instrument 10A may be deployed in the wellbore 18 as part of the wireline instrument string (13 in FIG. 1) substantially as explained with reference to FIG. 1. When it is determined that the instrument 10A is disposed within a formation of interest, e.g., by monitoring measurements from the gamma ray sensor (14 in FIG. 1), movement of the wired pipe string (20 in FIG. 1) may be stopped, and the instrument 10A may be deployed to withdraw fluid samples by extending back up pads 102 from the instrument 10A laterally and into contact the wellbore wall. For example, commands may be automatically or manually transmitted from the surface to the instrument 10A to withdraw fluid samples, for example. System components for deployment of such pads are well known in the art. By deploying the pads 102, the instrument 10A may be urged to contact the wall of the wellbore (18 in FIG. 1) so that an elastomer packer 104 or similar annular sealing element engages the wellbore wall. The packer 104 seals against the wellbore wall so that a fluid sample probe 106 disposed, for example, in the center of the packer 104 may engage the formation that forms the wellbore wall, as shown in FIG. 5. A pump 115 in the instrument 10A causes fluid to move from the formation by reducing pressure on the probe 106. The fluid flows through the probe 106 into sample lines 108 in the instrument 10A. As the fluid is moved through the sample lines 108, the fluid enters a test chamber 110 in series fluid communication therewith. The test chamber 110 may include a radiation transparent tube or similar structure, as will be further explained below. The pump 115, by continued operation thereof moves the fluid out of the test chamber 110 and into the wellbore 18. Such fluid discharge is known as "pump out" and is performed to minimize the volume of fluid stored in the sample tanks (not shown) consisting of "mud filtrate" (defined below).

During operation of the fluid test instrument 10A as shown in FIG. 5, an energy source 112 irradiates the fluid in the sample chamber 110. A detector 114 receives energy as modified by the fluid present in the sample chamber 110 at any time. Signals from the detector 114 are communicated to the telemetry unit (88 in FIG. 4) in the power sub (12 in FIG. 1). The signals represent a physical characteristic of the fluid that may be used to identify whether the fluid at any moment in time is the liquid phase of the drilling fluid (30 in FIG. 1, called "mud filtrate") or is connate (native) fluid from the formations adjacent to the wellbore. Because the measurements from the detector 114 may be transmitted to the surface (i.e., to the recording system 38 in FIG. 1), the system operator may have substantially continuous, substantially instantaneous measurements of the property of the fluid in the test chamber 110. The system operator may use such measurements to determine when the instrument 10A may be reconfigured to withdraw a sample of fluid into one or more sample storage tanks (not shown in FIG. 5). Alternatively, the power sub (12 in FIG. 4) may include logic operable to determine from the fluid property measurements when native fluid is being withdrawn through the sample chamber 110 and to automatically reconfigure the instrument 10A for fluid sample storage. In addition, the power sub 12 may automatically request information and/or data from the surface to determine the fluid property measurements and/or to control operation of the instrument 10A.

Measurements made by various other sensors in the wireline instrument string (13 in FIG. 1) can provide indication whether certain operating conditions exist or have been met. The following description is stated in terms of providing an indication to the system operator so that the system operator may take certain action in response. It is to be clearly understood that the measurements may also be used to cause automatic action, for example, as explained above with respect to reconfiguring the formation fluid sample taking instrument 10A. In principle, any measurement of operating condition made by a sensor in the instrument string may be used to effect automatic change in operations of the instrument string, any sensors therein and/or deployment by the drilling unit (24 in FIG. 1). Therefore, any reference to the system operator acting in response to a measurement is to be construed with respect to the present invention as being equally applicable to automatic performance of substantially the same action.

The energy source 112 and detector 114 may be any types suitable for determining a property of the fluid to enable discrimination between mud filtrate and native fluid, and the material from which the test chamber 110 is made should be transparent to the specific radiation used to analyze the fluid therein. Radiation is, therefore, intended to include energy which may travel through the wall of the test chamber 110 and be modified in some manner by the fluid therein to cause a detectable effect in the measurements made by the detector 114 based on the origin of the fluid. Non-limiting examples of the foregoing include (i) respective electrical resistivity current source an measurement electrodes or induction transmitter and receiver coils, (ii) nuclear magnetic resonance (NMR) transmitter and receiver antennas to measure NMR relaxation properties, (iii) gamma ray source and gamma ray detector to measure density, (iv) neutron source and neutron detectors to measure hydrogen index and/or neutron capture cross section, (v) high frequency electromagnetic radiation source and detector configured to measure dielectric constant, (vi) acoustic source and detector for measuring apparent sound velocity, and (vii) optical light source and sensors operating in the infrared, ultraviolet, and visible wavelengths to measure optical transmissibility.

Figure 6:
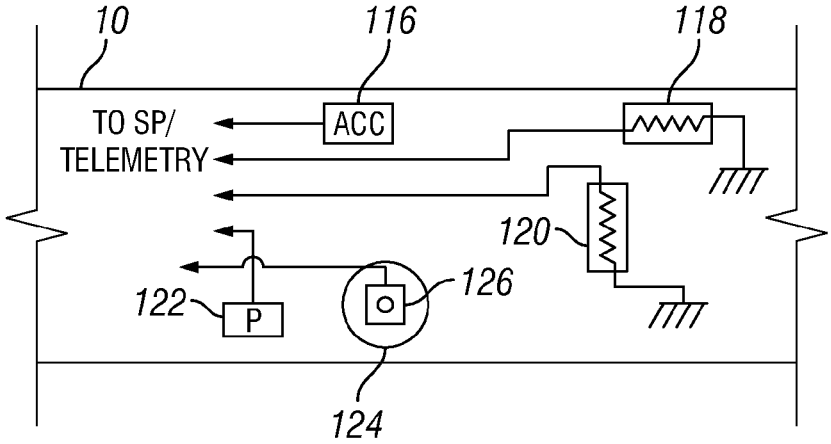
FIG. 6 shows an example well logging instrument including sensors for determining whether the instrument is moving within the wellbore.

In another aspect, a well logging instrument string 13 may include one or more sensors related to movement of the instrument string within the wellbore (18 in FIG. 1) so that the system operator may be alerted to conditions in the wellbore, the instrument string or the pipe string that may expose the instrument string to risk of loss or damage. FIG. 6 shows an example of a well logging instrument (e.g., the acoustic instrument or resistivity instrument) 10 which includes particular examples of sensors for making such measurements. The instrument 10 may include a strain gauge 118 disposed on or near the instrument exterior surface such that changes in axial loading on the instrument 10 may be determined. A second strain gauge 120 may be positioned on or near the instrument surface so that changes in torsion and/or bending strain on the instrument 10 may be determined. In some examples, an accelerometer 116 may be disposed in or on the instrument in order to determine any changes in velocity of the instrument 10 as it traverses the wellbore (18 in FIG. 1) or the wired pipe string (20 in FIG. 1). In some examples, a pressure sensor 122 may be disposed in the instrument 10 so as to measure pressure outside the instrument 10. If suitably rotationally oriented, i.e., in a downward direction, the pressure sensor 122 may be responsive to formation fluid pressure as the instrument 10 is moved along the wellbore. Measurement may occur because gravity will tend to cause the instrument to slide along the lower wellbore wall. Rotary orientation of the instrument may be determined, for example using magnetometers or accelerometers (not shown) suitably arranged with respect to a plane normal to the longitudinal axis of the instrument 10. The strain gauges 118, 120, accelerometer 116 and/or the pressure sensor 122 may be positioned on or within repeaters that may be present in the wired drill string 20.

Each of or any combination of the foregoing sensors and the measurements therefrom may be used to determine if, during insertion of the instrument 10 into the wellbore (18 in FIG. 1) or withdrawal from the wellbore, whether the instrument 10 is actually moving. The measurements from each of or all the sensors may be communicated to the recording system (38 in FIG. 1) by the telemetry (88 in FIG. 4) in the power sub (12 in FIG. 1). In the case of the strain gauges 118, 120, for example, increase in axial strain, such as by increase in compression during insertion or increase in tension during withdrawal may indicate the instrument has become stuck in the wellbore. The system operator may be able to take corrective action before excessive axial strain is applied to the instrument. Corresponding indications and action may be taken with reference to torsional strain by using the torsional strain gauge 120.

If a resistivity measurement instrument (e.g., 16 in FIG. 1) is used in the wireline instrument string (13 in FIG. 1), resistivity measurements related to a lateral distance proximate the wellbore wall, with corresponding short axial resolution, may be used to determine if the instrument is moving along the wellbore. Particular resistivity measurement devices that may be suited to provide such measurements include, for example those identified by the service marks SFL, MICROLOG, MICCROLATEROLOG and LATEROLOG 8, each of which is a service mark of the assignee of the present invention. Movement of the instrument is determined, using any of the foregoing, by observing the measurement between successive interrogations of the instrument. It has been observed that the foregoing instruments have sufficiently small axial resolution that a constant measurement value between successive measurement samples, whether time or depth based, is indicative of the instrument not moving within the wellbore. Non-movement of the instrument while the top drive (26 in FIG. 1) is moving axially may indicate risk to the wireline instrument string (13 in FIG. 1) and that the system operator should observe other measurements carefully, e.g., the axial strain measurement to reduce the risk of instrument damage.

The accelerometer 116 may be interrogated and its measurements integrated to determine an estimated instrument velocity. A velocity of the wired pipe string (20 in FIG. 1) may be estimated by measuring position with respect to time of the top drive (26 in FIG. 1). If the integrated acceleration measurements differ from the top drive velocity measurements by more than a predetermined threshold, the system operator may determine that the instrument 10 (or the wireline instrument string 13 in FIG. 1) is becoming or is actually stuck in the wellbore. Corrective action to avoid damage may be taken in such circumstances. Again, the corrective action may comprise automatically or manually transmitting control signals from the surface and/or from a downhole component, such as the wireline instrument string 13.

Measurements from the pressure sensor 122 may be communicated to the recording system (38 in FIG. 1). The system operator may observe such measurements, or such measurements may be compared, e.g., in the recording system to expected pressure in the wellbore annulus (the space between the wellbore wall and the instrument/pipe string). The expected pressure is related to the density of the drilling fluid (30 in FIG. 1), gravitational acceleration and the vertical depth at any point in the wellbore, as is known in the art. If the expected annulus pressure exceeds the measured pressure by a predetermined amount, the system operator may be alerted to the possibility that the instrument 10 may become stuck in the wellbore by differential pressure. Of course, a signal may be transmitted to the surface for analysis by a surface processor, which may automatically take corrective action.

The measurements of acceleration from the accelerometer 116 may also be integrated to determine instrument position with respect to time. The position information from the integrated acceleration measurements may be used to correct measurements made by the other sensors in the wireline instrument string (13 in FIG. 1) for irregular motion of the wireline instrument string (13 in FIG. 1) with respect to movement of the wired pipe string (20 in FIG. 1). The position information made from the accelerometer 116 measurements may also be used to correct information about the depth in the wellbore (18 in FIG. 1) of any particular sensor in the wireline instrument string (13 in FIG. 1). Typically such sensor depths are inferred by measurements of the elevation of the top drive (26 in FIG. 1), the length of the various components of the wired pipe string (20 in FIG. 1) and instrument string (13 in FIG. 1) and the longitudinal position of the particular sensor on the particular instrument. It has been observed that motion of the top drive (26 in FIG. 1) may not correspond precisely to movement of the remainder of the pipe string (20 in FIG. 1) due to friction between the pipe string (20 in FIG. 1) and the wall of the wellbore (18 in FIG. 1). The foregoing acceleration based position measurements may be used to correct sensor depth measurements made using top drive elevation information.

Another sensor that may be included in some examples is a rotary encoder 126 rotationally coupled to a frictional contact wheel 124. The frictional contact wheel 124 may be in contact with the wellbore (18 in FIG. 1) wall and will rotate corresponding to linear movement of the instrument 10 along the wellbore (18 in FIG. 1). The encoder 126 thus generates a signal that corresponds to the longitudinal movement of the instrument 10 along the wellbore wall. Such signal may be communicated to the recording system (38 in FIG. 1) along with or in substitution for the above described acceleration measurements in order to correct measurements of depth of any sensor based on position of the wired pipe string (20 in FIG. 1) as a result of any differential movement of the instrument 10 with respect to the elevation of the top drive (26 in FIG. 1).

In some examples, the measurements made by the accelerometer 116 and/or the strain gauges 118, 120 may be compared to peak values associated with damaging shock to the instrument 10A. In the case of accelerometer 116 measurements, the measurements are directly proportional to the shock applied to the instrument 10A. In the case of strain gauge 118, 120 measurements, the shock applied to the instrument is related to the inertia of the instrument (related to its mass and/or rotational moment of inertia) and the acceleration. In any case, indication of shock applied to the instrument in excess of safe levels may provide the system operator with warning to adjust operations on the drilling unit (24 in FIG. 1) to avoid damage to the instrument 10A. The same principle may be applied to any and all instruments in the well logging instrument string (13 in FIG. 1).

In other examples, measurements of pressure using the pressure sensor 122 that exceed a safe threshold, or predetermined threshold, may provide the system operator with warning to adjust operations on the drilling unit 924 in FIG. 1), for example, withdrawing the instrument string (13 in FIG. 1) from the wellbore (18 in FIG. 1) to a shallower depth or to reduce hydrostatic pressure in the wellbore (18 in FIG. 1) by reducing drilling fluid density, or by reducing fluid pressure applied at the surface if using a dynamic annular pressure control system. See, for example, U.S. Pat. No. 6,904,981 issued to van Riet. Again, automatic action may be taken by, for example, the transmission of control signals from the surface.

Figure 7:
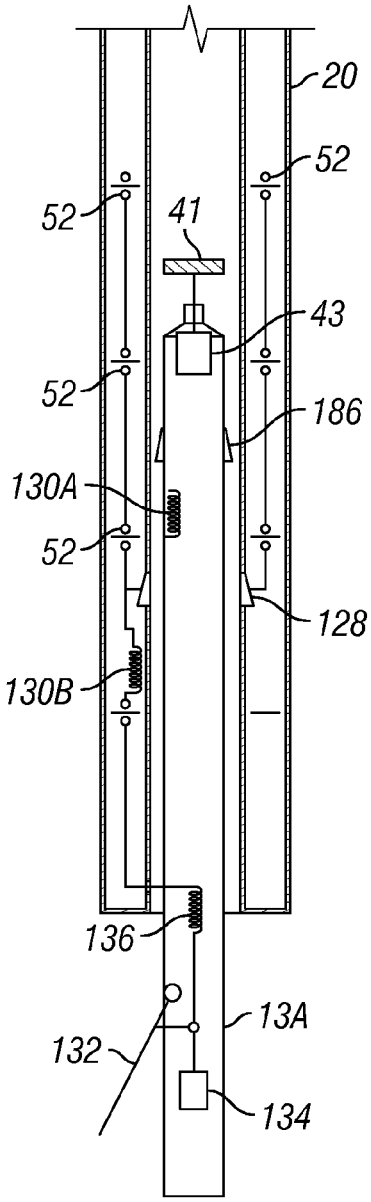
FIG. 7 shows another example of a wireline configurable well logging instrument string.

Another example of a wireline configurable well logging instrument string is shown in FIG. 7. The instrument string 13A may be configured to move along the interior of the pipe string 20 rather than being fixedly coupled to the lower end thereof. The instrument string 13A may include a latch 186 that mates with a latch receiver 128 in or on the pipe string 20, such as in the interior of the pipe string 20. The instrument string 13A may be caused to move, for example, by pressure from the drilling fluid being pumped through the pipe string 20. The instrument string 13A may include the turbine 41 and generator 43 otherwise disposed in the power sub (12 in FIG. 1), or may include batteries or mass power storage (not shown) to electrically operate the instrument string 13A. In the present example, an electromagnetic signal coupling 130A may be provided in the instrument string 13A at a selected position. When the instrument string 13A is positioned such that the latch 186 is engaged with the latch receiver 128, the signal coupling 130A is disposed adjacent to a corresponding signal coupling 130B in the pipe string. Engagement may be determined when a suitable signal is communicated through the signal couplings 130A, 130B from the instrument string 13A to the recording system (38 in FIG. 1) and/or to the surface. The system operator may obtain confirmation that the instrument string 13A is deployed correctly for measurement operations.

In some examples, the instrument string 13A may include a laterally displaceable device such as a caliper 132. The caliper 132 may be used to laterally urge the instrument string 13A or parts thereof into contact with the wellbore (18 in FIG. 1) wall, and to measure an apparent diameter of the wellbore (18 in FIG. 1). The caliper 132 may be deployed and retracted by a suitable device 134 such as an hydraulic cylinder, bow spring or any other caliper deployment device known in the art. A sensor 136 such as a potentiometer of linear variable differential transformer coupled to the caliper deployment device 134 may provide an indication of the lateral extension of the caliper 132. The caliper sensor 136 signal may be communicated to the recording system (38 in FIG. 1) using the communication channel in the pipe string 20 (e.g., using communication devices 52 as explained above) so that the system operator will obtain a substantially continuous indication of the caliper position. In some instances, the caliper may be determined to be extended by way of the sensor 136 measurements. The system operator will be informed of such circumstances and may take action to prevent the instrument string 13A from being moved downwardly, thereby preventing possible damage to the caliper 132. The caliper 132 and associated devices may be also used in instrument strings (13 in FIG. 1) such as explained with reference to FIGS. 1 and 2, where the instrument string (13 in FIG. 1) is fixedly coupled to the wired pipe string (20 in FIG. 1).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wellbore instrument system, comprising:

a pipe string extending from earth's surface into a wellbore, wherein at least a portion of the pipe string includes a signal communication channel for transmitting data therein;

a wireline configurable wellbore instrument coupled to the pipe string and capable of measuring a formation characteristic, wherein the wireline wellbore configurable instrument comprises a caliper laterally extensible from the instrument;

a sensor in communication with the pipe string or the wireline configurable wellbore instrument, the sensor configured to measure a characteristic effecting operation of the wireline configurable wellbore instrument, wherein the sensor comprises a caliper extension sensor; and a power sub coupled to the pipe string and in communication with the wireline configurable wellbore instrument, the power sub configured to transmit power to the wireline configurable wellbore instrument.

2. The wellbore instrument system of claim 1 wherein the characteristic effecting operation of the wireline configurable wellbore instrument includes at least one of movement of the instrument, change in an instrument operating condition, and an environmental condition proximate the instrument.

3. The wellbore instrument system of claim 1 wherein the power sub includes a turbine for converting flow of fluid through the pipe string into power and transmits power to the wireline configurable wellbore instrument.

4. The wellbore instrument system of claim 1 wherein the portion of the pipe string having a signal communication channel includes pipe segments threadedly coupled end to end, each pipe segment including at least one signal communication device in a longitudinal end thereof for coupling signals to the pipe segment.

5. The wellbore instrument system of claim 1 wherein the sensor comprises at least one of a strain gauge, an accelerometer, a pressure gauge, a fluid property sensor and a motion sensor.

6. The wellbore instrument system of claim 1 wherein the power sub receives data from the sensor and automatically transmits a control signal to the wireline configurable wellbore instrument based on the data received from the sensor.

7. The wellbore instrument system of claim 1 further comprising a surface processor in communication with the pipe string, wherein the surface processor receives data from the sensor and automatically transmits a control signal to the wireline configurable wellbore instrument based on the data received from the sensor.

8. The wellbore instrument system of claim 1 wherein the sensor comprises at least one of a voltmeter, a current meter and a temperature sensor.

9. The wellbore instrument system of claim 1 wherein the wireline wellbore configurable instrument is configured to move within the pipe string, wherein the wireline wellbore configurable instrument and at least one of the pipe string and the power sub each include a latch component configured to secure the wireline wellbore configurable instrument in a selected longitudinal position within the pipe string, wherein the sensor is positioned on at least one of the pipe string and the wireline wellbore configurable instrument to determine engagement of the respective latch components.

10. A wellbore instrument system, comprising:

a pipe string extending from earth's surface into a wellbore, wherein at least a portion of the pipe string includes a signal communication channel for transmitting data therein;

a wireline configurable wellbore instrument coupled to the pipe string and capable of measuring a formation characteristic;

a sensor in communication with the pipe string or the wireline configurable wellbore instrument, the sensor configured to measure a characteristic effecting operation of the wireline configurable wellbore instrument; and a power sub coupled to the pipe string and in communication with the wireline configurable wellbore instrument, the power sub configured to transmit power to the wireline configurable wellbore instrument wherein the power sub has a battery to transmit power to the wireline configurable wellbore instrument and further wherein the wireline configurable wellbore instrument has a battery in power communication with the battery of the power sub.

11. A method for well logging, comprising:

moving a wireline configurable wellbore instrument along a wellbore at one end of a segmented pipe string, the pipe string including a wired signal communication channel associated therewith wherein the moving along the wellbore comprises moving the instrument along an interior of the pipe string;

determining when the instrument is disposed at a selected longitudinal position with respect to the pipe string;

communicating a measurement from a sensor in the wireline configurable wellbore instrument to the wired signal communication channel;

detecting the measurements at a surface end of the wired signal communication channel; and changing operation of the wireline configurable wellbore instrument in response to the measurements.

12. The method of claim 11 wherein the measurement comprises a parameter related to movement of the wireline configurable wellbore instrument.

13. The method of claim 12 wherein the parameter related to movement comprises at least one of axial strain, torsional strain, axial acceleration, linear motion and formation resistivity.

14. The method of claim 11 wherein the measurement comprises fluid pressure in the wellbore.

15. The method of claim 11 further comprising:

measuring an instrument operating parameter with the sensor; and determining whether the instrument operating parameter is within a predetermined range.

16. The method of claim 15 wherein the at least one instrument operating parameter comprises one of instrument voltage, instrument current and instrument temperature.

17. The method of claim 15 further comprising transmitting the instrument operating parameter to the surface using the communication channel wherein the determining whether the instrument operating parameter is within a predetermined range is performed by a surface processor.

18. The method of claim 15 further comprising transmitting a control signal to the wireline configurable wellbore instrument based on the operating parameter without communication of the operating parameter to a surface processor.

19. The method of claim 11 wherein the changing operation comprises at least one of inserting the instrument into the wellbore, withdrawing the instrument from the wellbore and reconfiguring an operation of the wireline configurable wellbore instrument.

20. The method of claim 11 wherein the sensor comprises an accelerometer, the method further comprising:

integrating acceleration measurements from the accelerometer to determine instrument position with respect to time; and correcting measurements of depth of the instrument with respect to time made from measurements of drill string elevation using the integrated acceleration measurements.

21. A method for well logging, comprising:

moving a wireline configurable wellbore instrument along a wellbore at one end of a segmented pipe string, the pipe string including a wired signal communication channel associated therewith wherein the moving along the wellbore comprises moving the instrument along an interior of the pipe string, the method further comprising determining when the instrument is disposed at a selected longitudinal position with respect to the pipe string;

communicating a measurement from a sensor in the wireline configurable wellbore instrument to the wired signal communication channel;

detecting the measurements at a surface end of the wired signal communication channel; and changing operation of the wireline configurable wellbore instrument in response to the measurements wherein the measurement comprises a property of a fluid withdrawn from a formation adjacent the wellbore, and the changing operation comprises selecting a discharge destination of the withdrawn fluid.

22. The method of claim 21 wherein the property of the fluid comprises at least one of electrical resistivity, a nuclear magnetic resonance property, density, hydrogen index, acoustic velocity and dielectric constant.

23. A method for well logging, comprising:

moving a wireline configurable wellbore instrument along a wellbore at one end of a segmented pipe string, the pipe string including a wired signal communication channel associated therewith;

communicating a measurement from a sensor in the wireline configurable wellbore instrument to the wired signal communication channel;

detecting the measurements at a surface end of the wired signal communication channel;

measuring an instrument operating parameter with the sensor;

determining whether the instrument operating parameter is within a predetermined range; and changing operation of the wireline configurable wellbore instrument in response to the measurements wherein the determining whether the instrument operating parameter is within a predetermined range is performed downhole and information related to the operating parameter is only transmitted to the surface if the operating parameter is outside of the predetermined range.

* * * * *